US006142610A

United States Patent [19]

Minemoto et al.

[11] Patent Number: 6,142,610

[45] Date of Patent: Nov. 7, 2000

[54] PRECISION EJECTION INK-JET PRINTING APPARATUS

[75] Inventors: Hitoshi Minemoto; Yoshihiro Hagiwara; Junichi Suetsugu; Tadashi Mizoguchi; Hitoshi Takemoto; Kazuo Shima; Toru Yakushiji; Tomoya Saeki, all of Niigata, Japan

[73] Assignee: NEC Corporation, Tokyo, Japan

[21] Appl. No.: 09/037,054

[22] Filed: Mar. 9, 1998

[30] Foreign Application Priority Data

Mar. 7, 1997 [JP] Japan ..... 9-053071

[51] Int. Cl.[7] ..... B41J 2/06

[52] U.S. Cl. ..... 347/55

[58] Field of Search ..... 347/5, 9, 14, 54, 347/55

[56] References Cited

U.S. PATENT DOCUMENTS

| | | | |
|---|---|---|---|
| 4,935,754 | 6/1990 | Miyazawa et al. | 347/55 |
| 5,646,659 | 7/1997 | Moriyama et al. | 347/55 |
| 5,874,972 | 2/1999 | Suetsugu et al. | 347/55 |
| 5,926,194 | 7/1999 | Hagiwara et al. | 347/55 |

FOREIGN PATENT DOCUMENTS

| | | |
|---|---|---|
| 60-228162 | 11/1985 | Japan . |
| 4-220352 | 8/1992 | Japan . |
| 8-309993 | 11/1996 | Japan . |
| 9-57978 | 3/1997 | Japan . |

*Primary Examiner*—Sandra Brase
*Attorney, Agent, or Firm*—Sughrue, Mion, Zinn, Macpeak & Seas, PLLC

[57] ABSTRACT

A precision ejection ink-jet printing apparatus to prevent self-ejection. Self-ejection is an ejection of coloring agent particles from an ink-ejection opening without an application of ejection voltage to an ejection electrode. The precision ejection ink-jet printing apparatus includes an ink chamber filled with a pigment type ink, an electrophoretic electrode for causing coloring agent particles in the pigment type ink to concentrate at ink ejection openings, a plurality of ejection electrodes for causing ejection of the coloring agent particles concentrated at the ink ejection openings toward a printing medium, and voltage controller for controlling a voltage to be applied to the electrophoretic electrode. The voltage controller gradually increases the applied voltage up to a predetermined target voltage. The gradual increase in voltage moderates the electrophoretic motion of the coloring agent particles, preventing self-ejection.

10 Claims, 8 Drawing Sheets

PRECISION EJECTION INK-JET PRINTING APPARATUS

BACKGROUND OF THE INVENTION

1. Field of the Invention

The present invention relates generally to an ink-jet printing apparatus. More specifically, the invention relates to an ink-jet printing apparatus for controlling a coloring agent particle in a pigment type ink by electrophoretic effect.

2. Description of the Related Art

In recent years, non-impact printing methods are attracting attention because they generate little noise during printing. An ink-jet printing method is quite dominant its capability of direct printing on a printing medium with a simple mechanism, and of printing on plain paper. Various systems of ink-jet printing apparatus have been proposed. Conventionally, an electrostatic ink jet printing apparatus prints by applying a voltage between an electrode provided on the back surface of the printing medium and a needle shaped ejection electrode, thereby making a coloring agent of an ink or the like fly toward the print medium by an electrostatic force of the generated electric field, as disclosed in Japanese Unexamined Patent Publication Nos. Showa 60-228162 and Heisei 8-309993.

FIG. 7 is a general illustration of the conventional electrostatic ink-jet printing apparatus. The shown conventional ink-jet printing apparatus includes an ink chamber 1 filled with a pigment type ink 10, an electrophoretic electrode 3 for causing coloring agent particles in the pigment type ink to move to concentrate at the ink ejection openings 2 by electrophoretic effect, a plurality of ejection electrodes for ejecting the coloring agent particle concentrated at the ink ejection openings 2, toward a printing medium 4, and an opposing electrode 9 arranged on a back surface of the printing medium 4 in opposition to the ejection electrodes 5.

The ink ejection openings 2 are separated per respective ejection electrodes 5 by flow passage walls 8 so that a convex meniscus of the pigment type ink 10 can be formed at the tip end of respective ejection electrodes. The ink chamber 1 connects to a not shown ink tank through an ink supply port 6 and an ink drain port 7 by a not shown tube. The pigment type ink 10 in the ink chamber 1 is under a back pressure and forced to circulate.

FIG. 8 is a chart of a waveform of a voltage that is applied to the electrophoretic electrode and the ejection electrode of the conventional ink-jet printing apparatus. Operation of the conventional ink-jet printing apparatus will be discussed with reference to FIGS. 7 and 8. The shown ink-jet printing apparatus utilizes electrophoretic effect to orient the coloring agent particles in one direction by applying an electric field to the pigment type ink containing charged coloring agent particles. Namely, by applying a constant voltage VI to the electrophoretic electrode 3 to apply the electric field to the ink chambers 1 filled with the pigment type ink 10, the coloring agent particles in the pigment type ink 10 move toward the ink ejection openings 2 at a certain electrophoretic motion speed to form a convex meniscus of the pigment type ink 1 at the tip ends of the ejection electrodes 5. Ejection occurs by electrostatic force when a pulse of voltage V2 is applied to the ejection electrodes 5 for a pulse period T0 particles move to concentrate to the tip end portion of the By electrostatic force, the coloring agent particles overcome the meniscus, the surface tension of the pigment type ink, viscosity, and so forth, to fly from the tip end of the ejection openings 5 toward the opposing electrode 9 as fine flying particles at a timing synchronized with the pulse form ejection voltage and to be deposited on a printing medium 4.

A problem encountered in the conventional ink-jet printing apparatus is a possibility of self-ejection causing coloring agent particles to eject without application of the pulse form ejection voltage on the ejection electrodes. Self-ejection degrades the image quality of what is printed.

Before discussion will be given for the cause of the self-ejection, brief discussion will be given for mobility of the coloring agent particle, charge relaxation time, and the time constant of deformation of meniscus.

The mobility $\alpha$ [(m/s)/V/m)] of the coloring agent particle is generally expressed by $\alpha=\epsilon\zeta/6\pi\mu$, wherein $\epsilon$ is a dielectric constant of a medium, $\zeta$ is a zeta potential, $\mu$ is a viscosity. The mobility $\alpha$ is a characteristic value specific to the pigment type ink used and is used for deriving the speed of motion of the coloring agent particles as they move to concentrate at the ink ejection openings in the electric field generated by a voltage applied to the electrophoretic electrode, The charge relaxation time is a period required to establish a balanced condition of the influence of the electric field caused in the pigment type ink by the voltage applied to the electrophoretic electrode, for which a ratio of an electric conductivity $\sigma$ of the pigment type ink and the dielectric constant $\epsilon$, and a time constant $\epsilon/\alpha$ may provide references. The time constant $\epsilon/\alpha$ is also a characteristic value specific to the pigment type ink to be used similar to the mobility $\alpha$. For instance, a time constant $\epsilon/\alpha$ of a pure water is about 1 $\mu$s.

The time constant of deformation of meniscus can be an indicia of the condition of variation of shape of the meniscus and is associated with the surface tension and viscosity of the pigment type ink, and the motion speed and degree of concentration of the coloring agent particles. Since the surface tension and the viscosity of the pigment type ink are characteristic values specific to the pigment type in question, they should be constant. Therefore, a primary factor in determining the time constant of deformation of the meniscus is the motion speed and degree of concentration of the coloring agent particles, which is dependent on the a voltage applied to the electrophoretic electrode. Accordingly, by controlling; the voltage applied to the electrophoretic electrode, the time constant of deformation of meniscus can be varied.

The reason will be discussed hereinafter. FIG. 5 shows the influence of the electric field caused in the pigment type ink upon the instantaneous change of the voltage applied to the electrophoretic electrode to a target voltage V1, until establishment of balance. By applying the targeted voltage V1 all at once, the coloring agent particles move toward the ink ejection openings simultaneously at a speed which can be calculated from the foregoing mobility $\alpha$. By simultaneous motion of the coloring agent particles toward the ink ejection openings, abrupt concentration of the coloring agent particles causes a meniscus to form. The shape of the meniscus is varied. Due to variation of the shape of the meniscus and certain external factor, the coloring agent particles can be ejected unwantedly. At this time, the time constant of deformation of meniscus to be an indicia of the condition of variation of the shape of the meniscus becomes smaller than a time constant $\epsilon/\sigma$ as shown in FIG. 6.

SUMMARY OF THE INVENTION

An object of the present invention is to simply prevent self-ejection from ejecting coloring agent particles without a pulse-form ejection voltage.

According to one aspect of the present invention, an ink-jet printing apparatus comprises:

an ink chamber filled with a pigment type ink;

an electrophoretic electrode for causing coloring agent particles in the pigment type ink to concentrate at ink ejection openings;

a plurality of ejection electrodes for causing ejection of the coloring agent particles concentrated to the ink ejection openings toward a printing medium; and voltage control means for controlling a voltage applied to the electrophoretic electrode to gradually increase the applied voltage to a predetermined target voltage.

Preferably, the voltage control means elevates the voltage applied to the electrophoretic electrode in stepwise fashion up to the predetermined target voltage, with a time constant of deformation of meniscus of the pigment type ink smaller than a time constant of the pigment type ink determined by an electric conductivity of the pigment type ink and a dielectric constant of the pigment type ink.

In the alternative, the voltage control means may elevate the voltage applied to the electrophoretic electrode in stepwise fashion up to the predetermined target voltage, with a time constant of deformation of meniscus of the pigment type ink greater than a time constant of the pigment type ink determined by an electric conductivity of the pigment type ink and a dielectric constant of the pigment type ink.

In the further alternative, the voltage control means may elevate the voltage applied to the electrophoretic electrode up to the predetermined target voltage with a time constant substantially equal to a time constant of the pigment type ink.

BRIEF DESCRIPTION OF THE DRAWINGS

The present invention will be understood more fully from the detailed description given herebelow and from the accompanying drawings of the preferred embodiment of the present invention, which should not be taken as limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
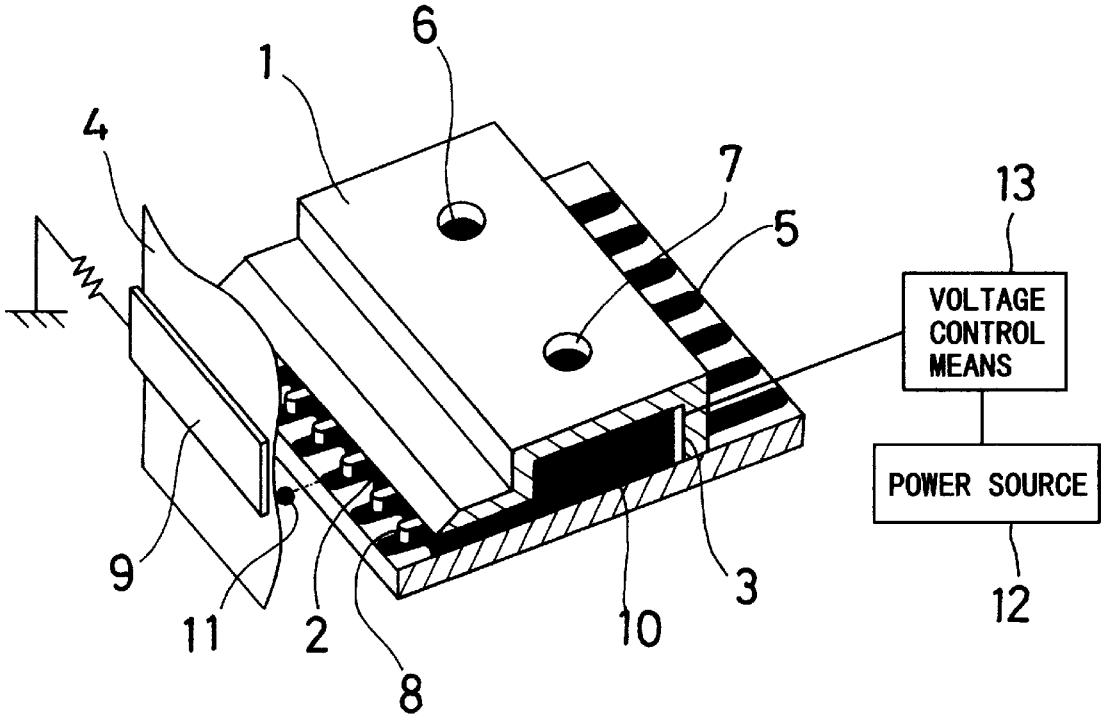
FIG. 1 is a fragmentary perspective view of an ink-jet printing apparatus according to the present invention.
Figure 7:
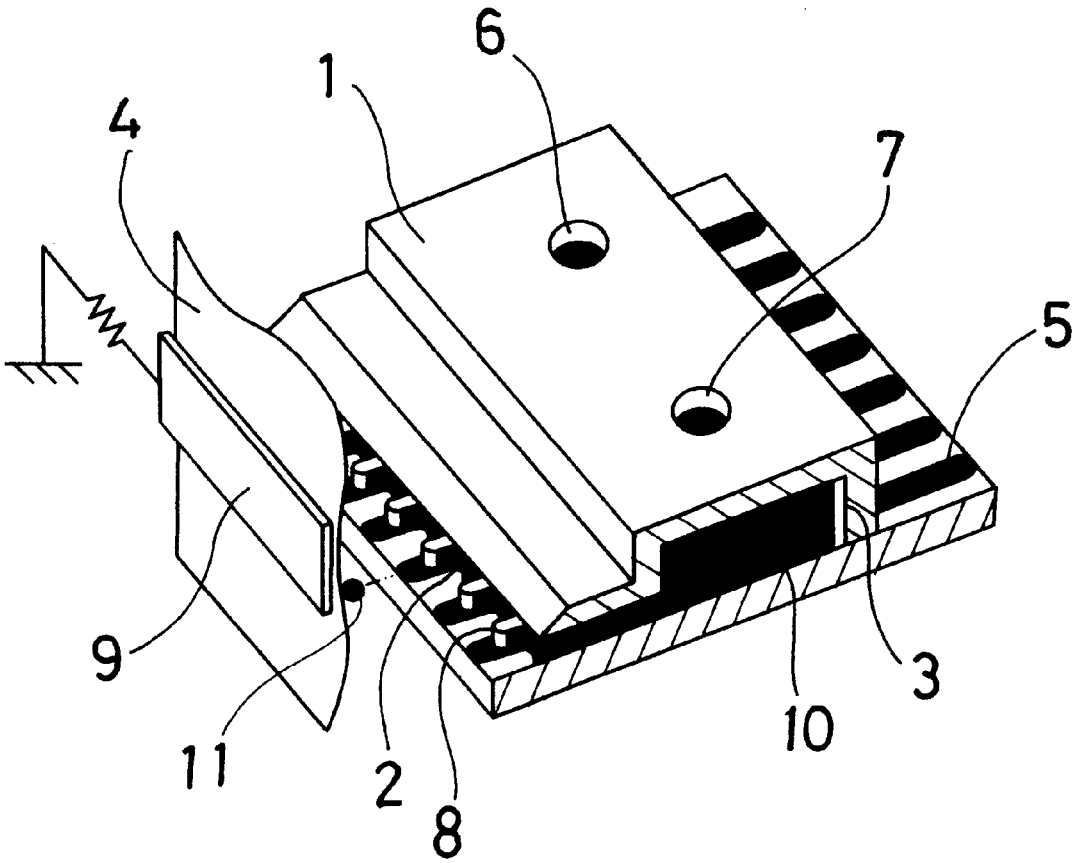
FIG. 7 PRIOR ART
FIG. 7 is a fragmentary illustration of the conventional ink-jet printing apparatus.

FIG. 1 shows a general construction of an ink-jet printing apparatus according to the present invention. In the shown ink-jet printing apparatus, in addition to the conventional construction shown in FIG. 7, a voltage control means 13 for controlling a voltage applied to the electrophoretic electrode 3 from a power source 12 is provided.

Figure 2:
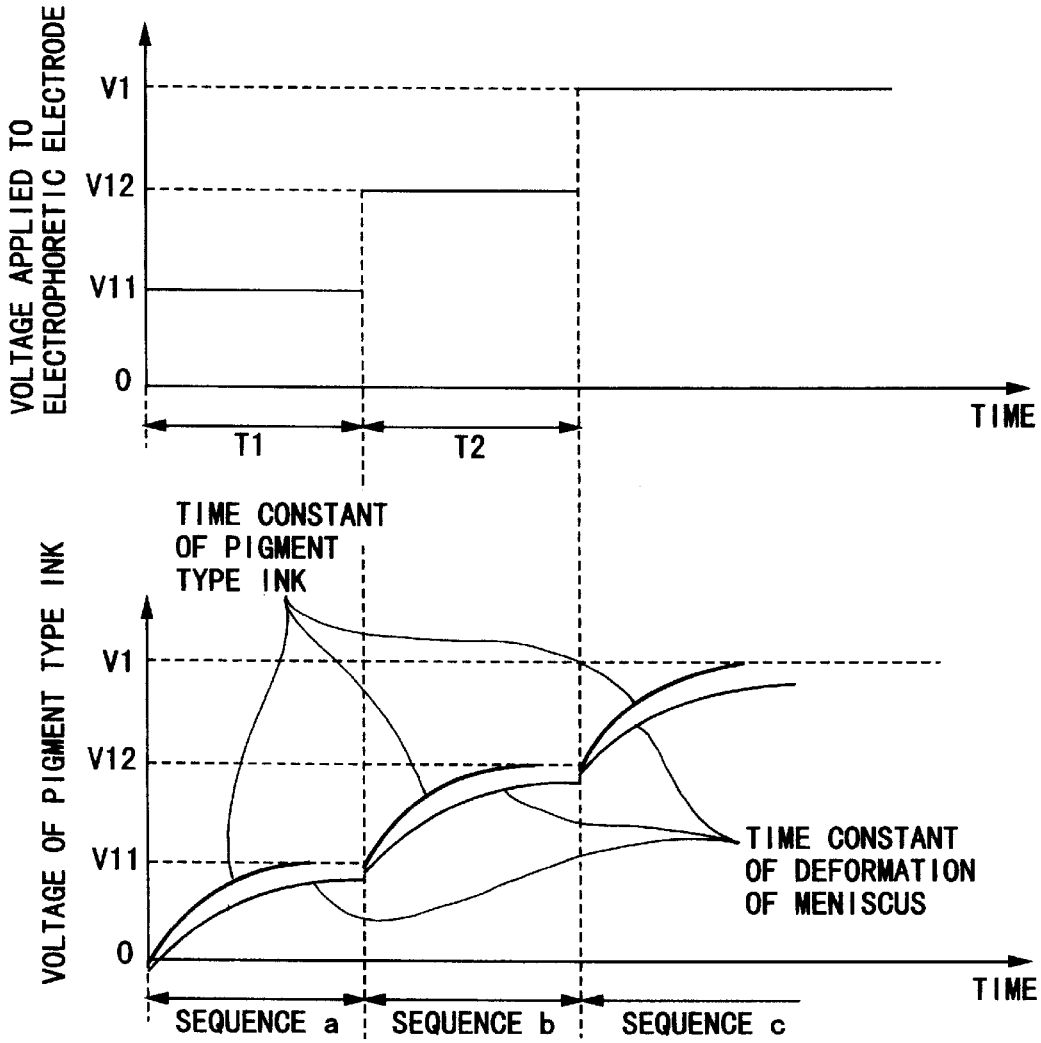
FIG. 2 is a chart showing a voltage waveform applied to an electrophoretic electrode in the first embodiment of the present invention and a voltage waveform of a pigment type ink.

FIG. 2 shows a waveform of a voltage to be applied to the electrophoretic electrode 3 by the voltage control means 13, together with a voltage waveform of the pigment type ink. Referring to FIG. 2, the voltage control means 13 varies the voltage applied to the electrophoretic electrode 3 in stepwise fashion so that a time constant of deformation of meniscus (shown by thick line in FIG. 2) is always smaller than a time constant $\epsilon/\sigma$ of the pigment type ink. In FIG. 2, a voltage V11 is initially applied to the electrophoretic electrode 3 for a period T1. Then, a voltage V12 is applied to the electrophoretic electrode for a period T2, and finally a target voltage is applied.

Figure 3:
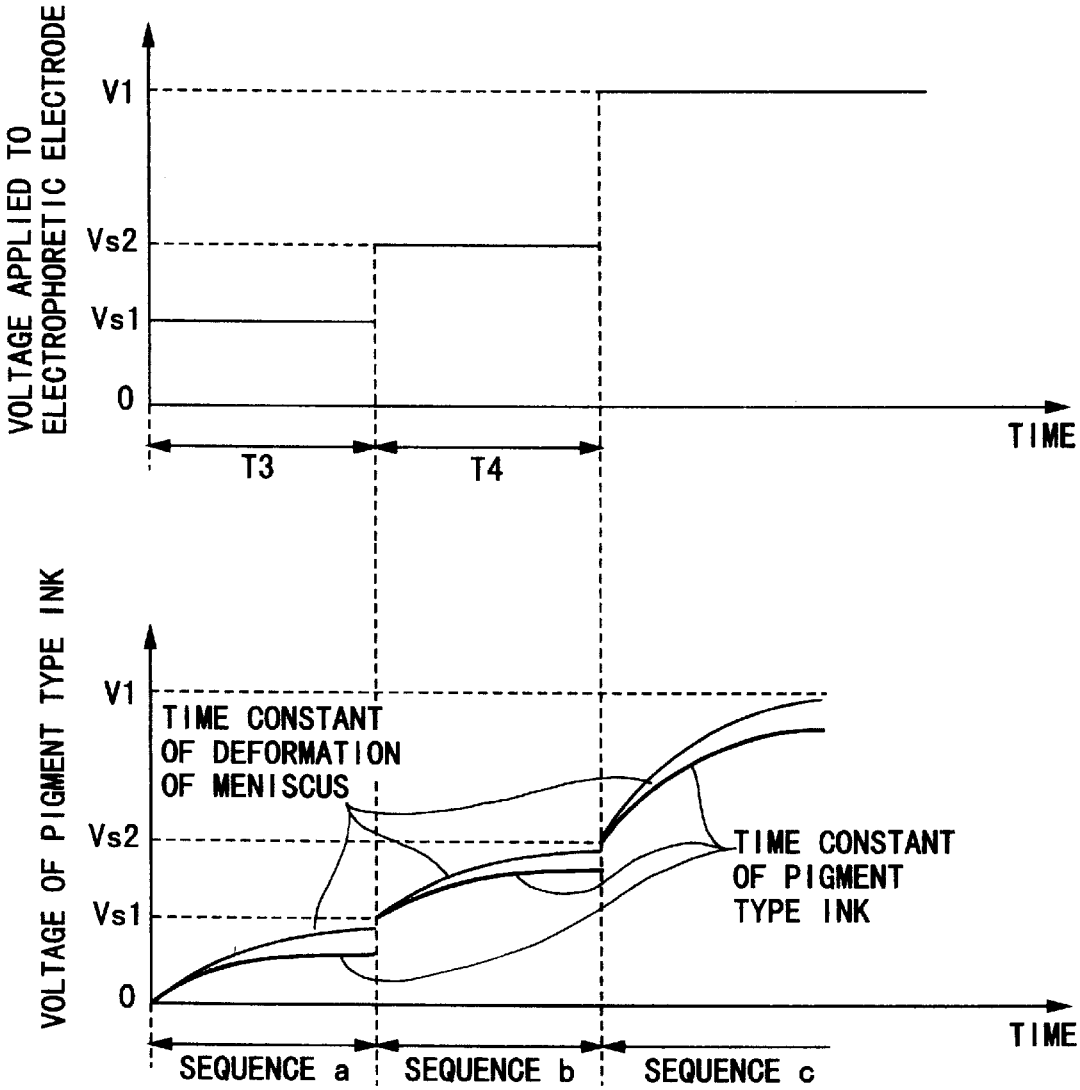
FIG. 3 is a chart showing a voltage waveform applied to an electrophoretic electrode in the second embodiment of the present invention and a voltage waveform of a pigment type ink.

FIG. 3 shows another waveform of a voltage to be applied to the electrophoretic electrode 3 by the voltage control means 13, together with a voltage waveform of the pigment type ink. Referring to FIG. 3, the voltage control means 13 varies the voltage applied to the electrophoretic electrode 3 in stepwise fashion so that a time constant of deformation of meniscus (shown by thick line in FIG. 2) is always greater than a time constant $\epsilon/\sigma$ of the pigment type ink. In FIG. 3, a voltage Vs1 is initially applied to the electrophoretic electrode 3 for a period T3. Then, a voltage Vs2 is applied to the electrophoretic electrode for a period T4, and finally a target voltage is applied. In FIGS. 2 and 3. V11>Vs1 and V12>Vs2.

Operation upon using the waveform of the applied voltage as shown in FIG. 2 will be discussed with making reference to FIG. 1.

Initially, a voltage V11 is applied to the electrophoretic electrode 3 for a period T1 to apply an electric field to the ink chamber 1 filled with the pigment type ink 10. Then, the coloring agent particles in the pigment type ink simultaneously cause motion toward the ink ejection openings at an electrophoretic speed determined by the mobility $\alpha$ and the electric field generated by the voltage V11. Thus, the coloring agent particles initiate motion toward the ink ejection openings 2 to cause deformation of meniscus at an earlier time than the elapsing of the charge relaxation time. However, at this condition, the intensity of the electric field generated is not sufficient to cause flying of the coloring agent particles from the ink ejection openings 2. Subsequently, after a period corresponding to the time constant $\epsilon/\sigma$, the surface of the pigment type ink 10 reaches a balanced condition. Then, the coloring agent particles stop (sequence a).

Next, after application of the voltage V11 to the electrophoretic electrode 3, another voltage V12 is applied to the electrophoretic electrode 3 for a period T2. Then, the electric field generated by application of the voltage V12 is applied to the ink chamber 1 filled with the pigment type ink 10. Then, from the condition of the sequence a, the coloring agent particles in the pigment type ink 10 cause motion toward the ink injection openings at an electrophoretic speed determined by the mobility $\alpha$ and the electric field generated by application of the given voltage V12. Thus, the coloring agent particles simultaneously cause the motion toward the ink ejection opening at an electrophoretic speed determined by the mobility $\alpha$ and the electric field generated by the voltage V12. Thus, the coloring agent particles initiate motion toward the ink ejection openings 2 to cause deformation of meniscus at earlier timing than the elapsing of the charge relaxation time. However, at this condition, the intensity of the electric field generated is not sufficient to cause flying of the coloring agent particles from the ink ejection openings 2. Subsequently, after a period corresponding to the time constant $\epsilon/\sigma$, the surface of the pigment type ink 10 reaches a balanced condition. Then, the coloring agent particles stop (sequence b).

After application of the voltage V12 to the electrophoretic electrode 3, the target voltage V1 is applied to the ink chamber 1 filled with the pigment type ink 10. From the condition of the sequence b, the coloring agent particles cause motion to the ink ejection openings 2 at the electrophoretic speed determined by the mobility $\alpha$ and the electric field caused by the targeted voltage V1. The coloring agent particles undergo simultaneous motion toward the ink ejection openings 2, again causing deformation of meniscus at an earlier time than the elapsing of the charge relaxation time. Thus, convex meniscus of the pigment type ink 10 is formed at the tip ends of the ejection electrodes (sequence c).

Figure 8:
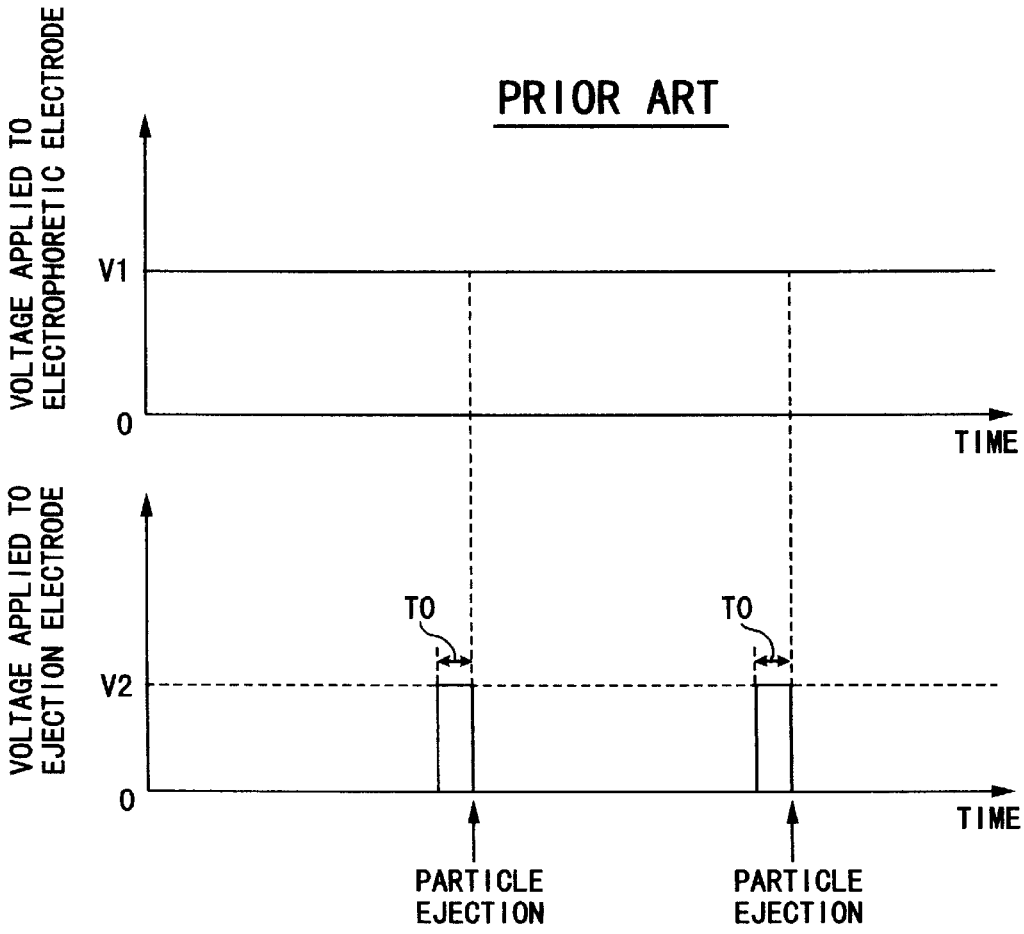
FIG. 8 is a chart showing a voltage waveform applied on the electrophoretic electrode and the ejection voltage in the prior art.

At this condition, a pulse form ejection voltage having a peak voltage V2 and a pulse period T0 as shown in FIG. 8 is applied to the ejection electrodes 5, performing ejection of the coloring agent particles. Then, the motion energy of the coloring agent particles caused by electrostatic force overcomes constraint forces, such as the meniscus, surface tension of the pigment type ink, viscosity and so forth, to generate a fine flying droplet group 11 flying from the tip ends of the ejection electrodes 5, to be deposited on the printing medium 4, the a timing synchronous with the timing of application of the pulse form ejection voltage.

Next, operation upon using the waveform of the applied voltage as shown in FIG. 3 will be discussed with references to FIG. 1.

Initially, a voltage Vs1 is applied to the electrophoretic electrode 3 for a period T3 to apply an electric field to the ink chamber 1 filled with the pigment type ink 10. Then, the coloring agent particles in the pigment type ink simultaneously cause motion toward the ink ejection opening at an electrophoretic speed determined by the mobility $\alpha$ and the electric field generated by the voltage Vs1. Thus, the coloring agent particles initiate motion toward the ink ejection openings 2, causing a deformation of the meniscus at an earlier time than the elapsing of the charge relaxation time. However, at this condition, since the time constant of deformation of meniscus is greater than the time constant $\epsilon/\sigma$, the motion of the coloring agent particles stops at a time where a balance condition is established on the surface of the pigment type ink, thus stopping deformation of the shape of the meniscus at the midway (sequence a).

Next, after application of the voltage Vs1 to the electrophoretic electrode 3, another voltage Vs2 is applied to the electrophoretic electrode 3 for a period T3 to apply an electric field to the ink chamber 1 filled with the pigment type ink 10. Then, the coloring agent particles in the pigment type ink simultaneously cause motion toward the ink ejection openings at an electrophoretic speed determined by the mobility $\alpha$ and the electric field generated by the voltage Vs2. Thus, the coloring agent particles initiate motion toward the ink ejection openings 2 to causing a deformation of meniscus at an earlier time than the elapsing of the charge relaxation time. However, even at this condition, since the time constant of deformation of meniscus is greater than the time constant $\epsilon/\sigma$, the motion of the coloring agent particles stops at a time where a balance condition is established on the surface of the pigment type ink, thus stopping deformation of the shape of the meniscus at the midway (sequence b).

After application of the voltage Vs2 to the electrophoretic electrode 3, the target voltage V1 is applied to the ink chamber 1 filled with the pigment type ink 10. From the condition of the sequence b, the coloring agent particles cause motion to the ink injection openings 2 from the condition of at an electrophoretic speed determined by the mobility $\alpha$ and the electric field caused by the target voltage V1. The coloring agent particles again undergo simultaneous motion toward the ink ejection openings 2. However, since the time constant of deformation of the meniscus is greater than the time constant $\epsilon/\sigma$, the coloring agent particle stops again at the condition where the surface of the pigment type ink 10 reaches a balanced condition. Thus, deformation of the meniscus due to concentration of the coloring agent particles again stops at the midway (sequence c).

At this time, a convex meniscus of the pigment type ink 10 is formed at the tip ends of the ejection electrodes. At this condition, a pulse form ejection voltage having a peak voltage V2 and a pulse period T0 as shown in FIG. 8 is applied to the ejection electrodes 5 performing ejection of the coloring agent particles. Then, the motion energy of the coloring agent particles caused by the electrostatic force overcomes constraint forces, such as meniscus, surface tension of the pigment type ink, viscosity and so forth, to generate a fine flying droplet group 11 flying from the tip ends of the ejection electrodes 5 to be deposited on the printing medium 4, with a timing synchronous with the timing of application of the pulse form ejection voltage. As set forth above, when the voltage waveform applied to the electrophoretic electrode shown in FIG. 3 is used, variation of the shape of the meniscus is variable depending upon the time constant $\epsilon/\sigma$ of the pigment type ink, so that the variation of the shape of the meniscus can be predicted.

Figure 4:
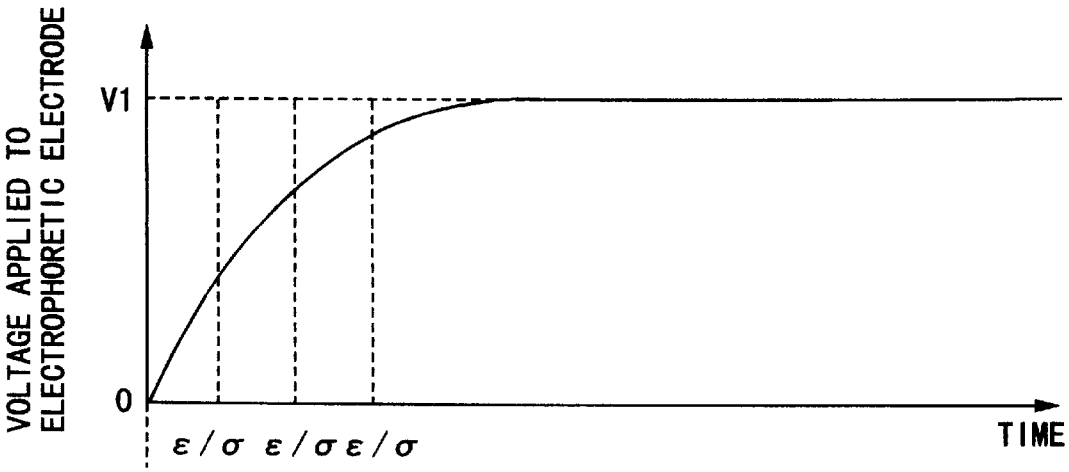
FIG. 4 is a chart showing a voltage waveform applied to an electrophoretic electrode in the third embodiment of the present invention.
Figure 5:
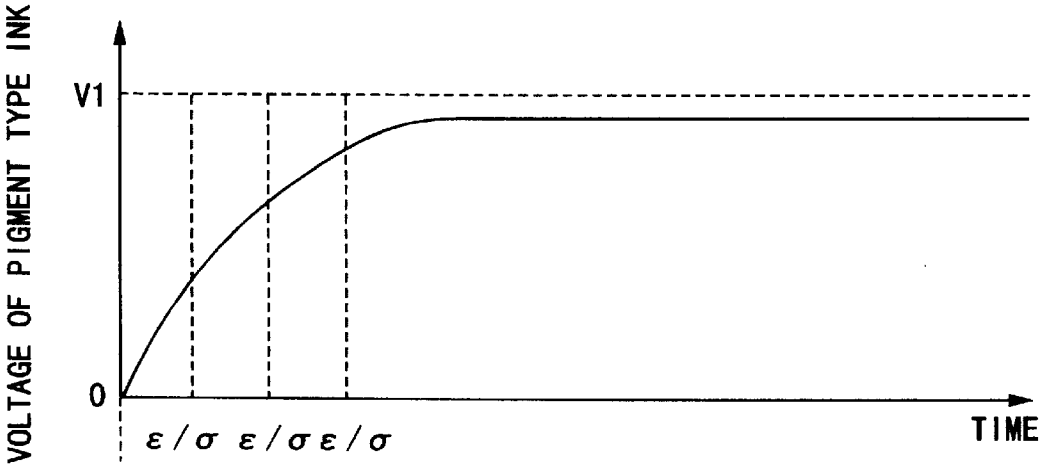
FIG. 5 is a chart showing variation of voltage of the pigment type ink upon application of a given voltage to an electrophoretic electrode.
Figure 6:
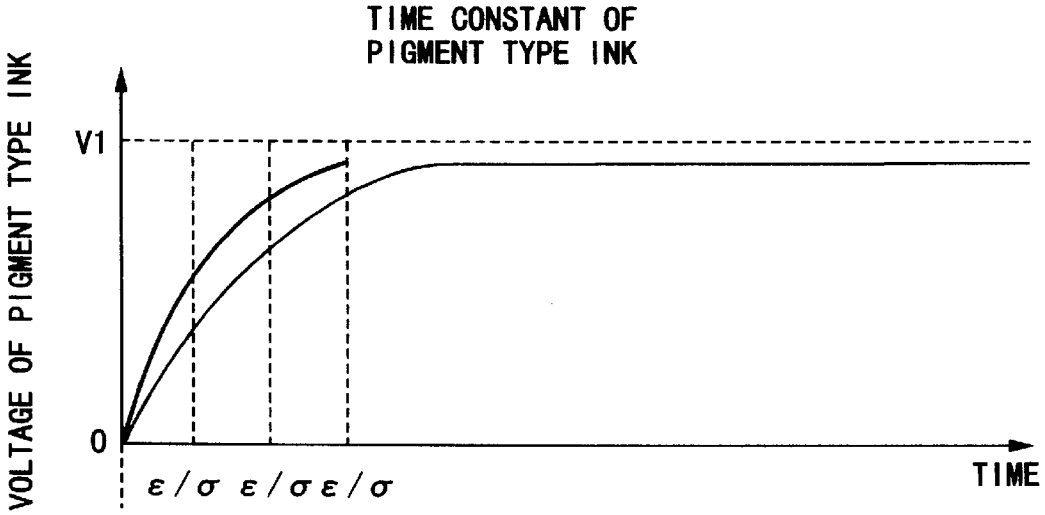
FIG. 6 is a chart showing a variation of a time constant of deformation of a meniscus.

FIG. 4 shows a further waveform of the voltage applied to the electrophoretic electrode 3 by the voltage control means 13. In this embodiment, the voltage control means controls the voltage applied to the electrophoretic electrode 3 so that the applied voltage is gradually increased during a period provided by the time constant $\epsilon\sigma$ of the pigment type ink.

As set forth above, according to the present invention, by gradually causing deformation of the meniscus of the pigment type ink during a period set by the time constant of the pigment type ink, self-ejection of the coloring agent particle without application of the pulse form ejection voltage to the ejection electrodes is avoided. Thus, the quality of the image to be formed by ejection of the ink can be stabilized.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An ink-jet printing apparatus comprising:

an ink chamber filled with a pigment type ink;

an electrophoretic electrode for causing coloring agent particles in said pigment type ink to concentrate at ink ejection openings;

a plurality of ejection electrodes for causing ejection of said coloring agent particles concentrated at said ink ejection openings toward a printing medium; and voltage control means for controlling a voltage applied to said electrophoretic electrode to gradually increase the applied voltage to a predetermined target voltage.

2. An ink-jet printing apparatus as set forth in claim 1, wherein said voltage control means elevates said voltage applied to said electrophoretic electrode in stepwise fashion to said predetermined target voltage, and wherein a time constant deformation of meniscus of said pigment type ink is smaller than a time constant of said pigment type ink determined by an electric conductivity of said pigment type ink and a dielectric constant of said pigment type ink.

3. An ink-jet printing apparatus as set forth in claim 1, wherein said voltage control means elevates said voltage applied to said electrophoretic electrode in stepwise fashion to said predetermined target voltage, and wherein a time constant of deformation of meniscus of said pigment type ink is greater than a time constant of said pigment type ink determined by an electric conductivity of said pigment type ink and a dielectric constant of said pigment type ink.

4. An ink-jet printing apparatus as set forth in claim 1, wherein said voltage control means elevates said voltage applied to said electrophoretic electrode to said predetermined target voltage, and wherein a time constant of deformation of meniscus of said pigment type ink is substantially equal to a time constant of said pigment type ink determined by an electrical conductivity of said pigment type ink and a dielectric constant of said pigment type ink.

5. An ink-jet printing apparatus as set forth in claim 1, wherein said voltage control means elevates said voltage applied to said electrophoretic electrode to said predetermined target voltage, with said voltage having an overall rise time substantially equal to a charge relaxation time of said pigment type ink.

6. An ink-jet printing apparatus comprising:

an ink chamber filled with a pigment type ink;

an electrophoretic electrode for causing coloring agent particles in said pigment type ink to concentrate at ink ejection openings;

a plurality of ejection electrodes for causing ejection of said coloring agent particles concentrated at said ink ejection openings toward a printing medium; and a voltage controller for controlling a voltage applied to said electrophoretic electrode to moderate motion of said coloring agent particles to said ink ejection openings by gradually increasing said voltage to a predetermined target voltage.

7. An ink-jet printing apparatus as set forth in claim 6, wherein said voltage controller elevates said voltage applied to said electrophoretic electrode in stepwise fashion to said predetermined target voltage, and wherein a time constant of deformation of meniscus of said pigment type ink is smaller than a time constant of said pigment type ink determined by an electric conductivity of said pigment type ink and a dielectric constant of said pigment type ink.

8. An ink-jet printing apparatus as set forth in claim 6, wherein said voltage controller elevates said voltage applied to said electrophoretic electrode in a stepwise fashion to said predetermined target voltage, and wherein a time constant of deformation of meniscus of said pigment type ink greater than a time constant of said pigment type ink determined by an electric conductivity of said pigment type ink and a dielectric constant of said pigment type ink.

9. An ink-jet printing apparatus as set forth in claim 6, wherein said voltage controller elevates said voltage applied to said electrophoretic electrode to said predetermined target voltage, and wherein a time constant of deformation of meniscus of said pigment type ink is substantially equal to a time constant of said pigment type ink determined by electrical conductivity of said pigment type ink and a dielectric constant of said pigment type ink.

10. An ink-jet printing apparatus as set forth in claim 6, wherein said voltage controller elevates said voltage applied to said electrophoretic electrode to said predetermined target voltage, said voltage having an overall rise time substantially equal to a charge relaxation time of said pigment type ink.

* * * * *

UNITED STATES PATENT AND TRADEMARK OFFICE

CERTIFICATE OF CORRECTION

PATENT NO. : 6,142,610
DATED : November 7, 2000
INVENTOR(S) : Hitoshi Minemoto, Yoshihiro Hagiwara, Junichi Suetsugu, Tadashi Mizoguchi, Hitoshi Takemoto, Toru Yakushiji; Tomoya Seki; Kazuo Shima It is certified that error appears in the above-identified patent and that said Letters Patent is hereby corrected as shown below:

Column 1,
Lines 63 & 64, delete "particles move to concentrate to the tip end portion of the" insert --.-- after "to"

Column 2,
Line 41, delete "a"

Column 6,
Line 16 & 17, delete "from the condition of";
Line 51, delete "Eσ" insert --E/σ--

Signed and Sealed this

Seventeenth Day of July, 2001

*Attest:*

Nicholas P. Godici

*Attesting Officer*

NICHOLAS P. GODICI
*Acting Director of the United States Patent and Trademark Office*